United States Patent [19]

Schwartzstein

[11] 4,261,490

[45] Apr. 14, 1981

[54] GARMENT HANGER

[75] Inventor: Marvin Schwartzstein, Rydal, Pa.

[73] Assignee: York Luggage Corporation, Lambertville, N.J.

[21] Appl. No.: 45,972

[22] Filed: Jun. 6, 1979

Related U.S. Application Data

[62] Division of Ser. No. 942,192, Sep. 14, 1978, Pat. No. 4,170,282.

[51] Int. Cl.[3] ..... A47J 51/094
[52] U.S. Cl. ..... 223/88
[58] Field of Search ..... 223/88

[56] References Cited

U.S. PATENT DOCUMENTS

| | | | |
|---|---|---|---|
| 2,137,268 | 11/1938 | Clairon | 223/88 X |
| 2,822,967 | 2/1958 | Spitz | 223/88 |
| 3,860,154 | 1/1975 | Atkins | 223/88 |
| 3,870,206 | 3/1975 | Feinberg | 223/88 |

FOREIGN PATENT DOCUMENTS

| | | | |
|---|---|---|---|
| 677987 | 8/1952 | United Kingdom | 223/88 |

*Primary Examiner*—Louis Rimrodt
*Attorney, Agent, or Firm*—Shapiro and Shapiro

[57] ABSTRACT

A garment hanger structure which is adapted for positioning in a garment bag comprising a pair of arms diverging from a top central portion, a hook, and means connecting said hook to said top central portion for selective movement about a pair of mutually perpendicular axes.

4 Claims, 9 Drawing Figures

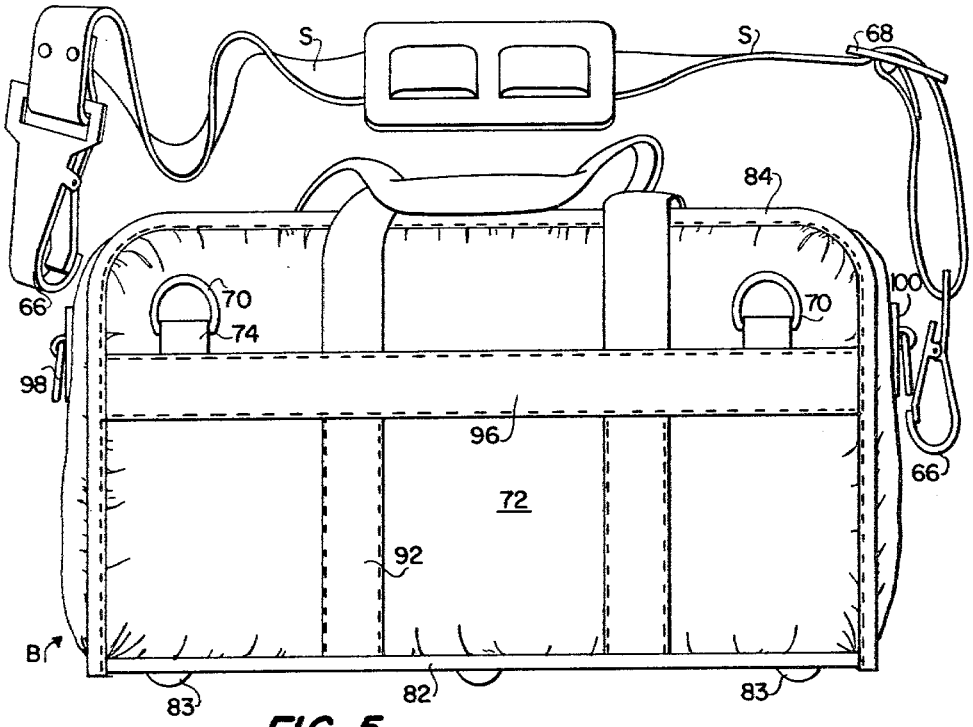
FIG. 5
FIG. 6
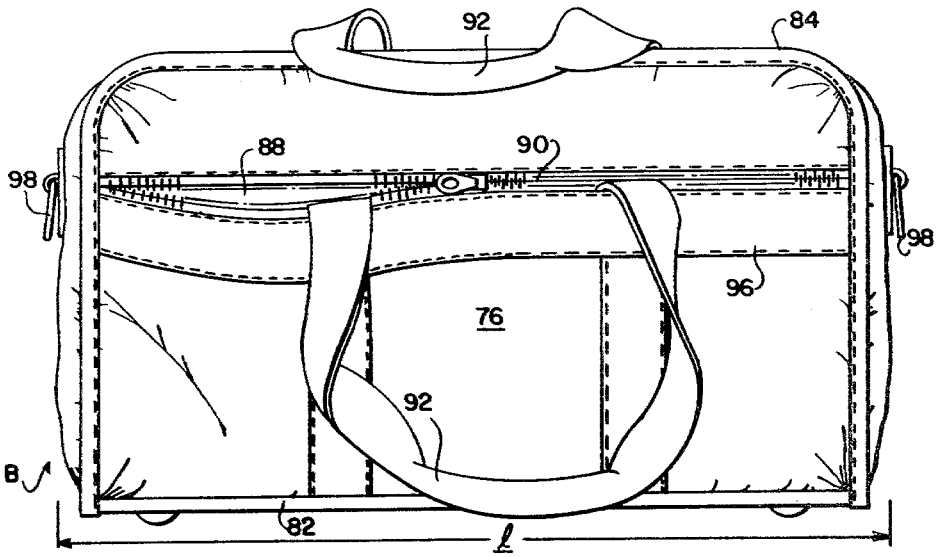

GARMENT HANGER

This is a division of application Ser. No. 942,192, filed Sept. 14, 1978, now U.S. Pat. No. 4,170,282 Oct. 9, 1979.

The invention relates to improvements in luggage of the multi-container-type, and is more particularly directed to luggage of the type which includes a flexible garment bag.

BACKGROUND OF THE INVENTION

In order to arrive at their destinations with their garments in unwrinkled condition, it is not uncommon for travellers to carry a garment bag and a second piece of luggage. This requires that the traveller carry the garment bag in one hand and the second piece of luggage in the other hand. In travelling by air, it is usually impossible to put both bags or pieces of luggage in the same place. Also, more and more air travellers are trying to circumvent the ordeal of claiming luggage at the baggage pick-up areas where a considerable amount of time is lost. If both pieces are brought on board, a tote bag or the like may be small enough to be put under a seat or in an overhead compartment. The garment bag however, is usually hung on a rack, which is located between economy and first class sections.

It has been proposed to provide luggage which is designed to carry garments and other articles. In Ekeson U.S. Pat. No. 3,729,038 it is proposed that a wrap-around cover which includes pockets to provide extra holding space for personal articles may also serve to retain clothing between the wrap-around cover and the carrying case about which the cover is positioned. No provision is made, however, for protecting the clothing from the sides, and when the cover is removed, the clothing falls away. The wrap-around of Ekeson is not a protective garment bag, and such arrangement has limitations. Moreover, the wrap-around is of a length to fit and be tailored to a particular bag.

In Komroff U.S. Pat. No. 3,291,266 a foldable garment bag is provided with a flap which is designed to be assembled into a carrying case in the sense that the integrity of the garment bag and the integrity of the carrying case are maintained.

Various kinds of container combinations are disclosed in U.S. patents to Ward—U.S. Pat. No. 3,122,225; Benzel—U.S. Pat. No. 3,410,376; Ohyama—U.S. Pat. No. 3,830,348; Honan—U.S. Pat. No. 3,837,447; and Gregg et al—U.S. Pat. No. 3,967,708.

BRIEF DESCRIPTION OF THE INVENTION

The luggage of the invention comprises a flexible garment bag and a tote bag or carrying case which are constructed to provide a unitary assembly to enable carrying both the garment bag and the tote bag with one hand or slung over the shoulder of the traveller, while affording the same suitable protection for clothing afforded by a known type of flexible garment bag and the same storage space and protection of a known carrying case or tote bag. In fact, together or assembled, there is a synergistic effect afforded by the assembly in that there is a minimum of wrinkling of the garment or garments within the garment bag, the total volume of both the garment bag and the tote bag is maintained, and the resultant overall package of the combination of bags is more convenient to carry than the garment bag alone or, stated in another way, the assembly of garment and tote bags is as convenient to carry as the tote bag alone. Moreover, the garment bag-tote bag assembly takes up a minimal amount of space considering the quantity of clothing and other goods which may be stored and transported by the assembly.

Briefly, the garment bag-tote bag assembly of the invention comprises a garment bag having first and second panels of flexible material connected to one another at their edges with the garment bag having a longitudinally extending opening provided with a closure as is common in the art. The tote bag has a length substantially equal to the width of the garment bag, and the garment bag has a length not less than the circumference of the tote bag. Connector means is secured to a wall of the tote bag and connector means is secured to the first panel of the garment bag for the separable connection of the garment bag and the tote bag. Longitudinally spaced cooperable connector means are secured to the second panel for separable connection to each other, and means is provided by one of the bags to enable carrying the garment bag-tote bag assembly.

With the aforementioned separable connector means in connected condition, the tote bag is enfolded by the garment bag. The tote bag serves or acts as a form about which the garment bag is wrapped, the enveloped tote bag providing a substantial radius of curvature to minimize wrinkling of a garment or garments positioned in the garment bag. If the tote bag is fully packed, and the garment bag is made to tightly envelope the tote bag, the connector means secured to a wall of the tote bag and the connector means secured to the first panel of the garment bag may be omitted.

Another aspect of the invention resides in the garment bag structure which enables its assembly with the tote bag to furnish the aforementioned purposes, functions and advantages and improved results.

Still another aspect of the invention resides in an improved hanger structure which is particularly adapted for positioning in a garment bag.

The advantages and improved results afforded by the garment bag-tote bag assembly of the invention, the garment bag structure of the invention, and the hanger of the invention will be apparent from the following detailed description of a preferred embodiment of invention, taken in conjunction with the drawings.

BRIEF DESCRIPTION OF THE DRAWINGS

FIG. 5 is an elevational view showing one side of the tote bag component of the assembly, this view also showing a shoulder strap;

FIG. 6 is an elevational view similar to FIG. 5 showing the opposite side of the tote bag, this view omitting the showing of the strap;

DESCRIPTION OF THE PREFERRED EMBODIMENT

Figure 1:
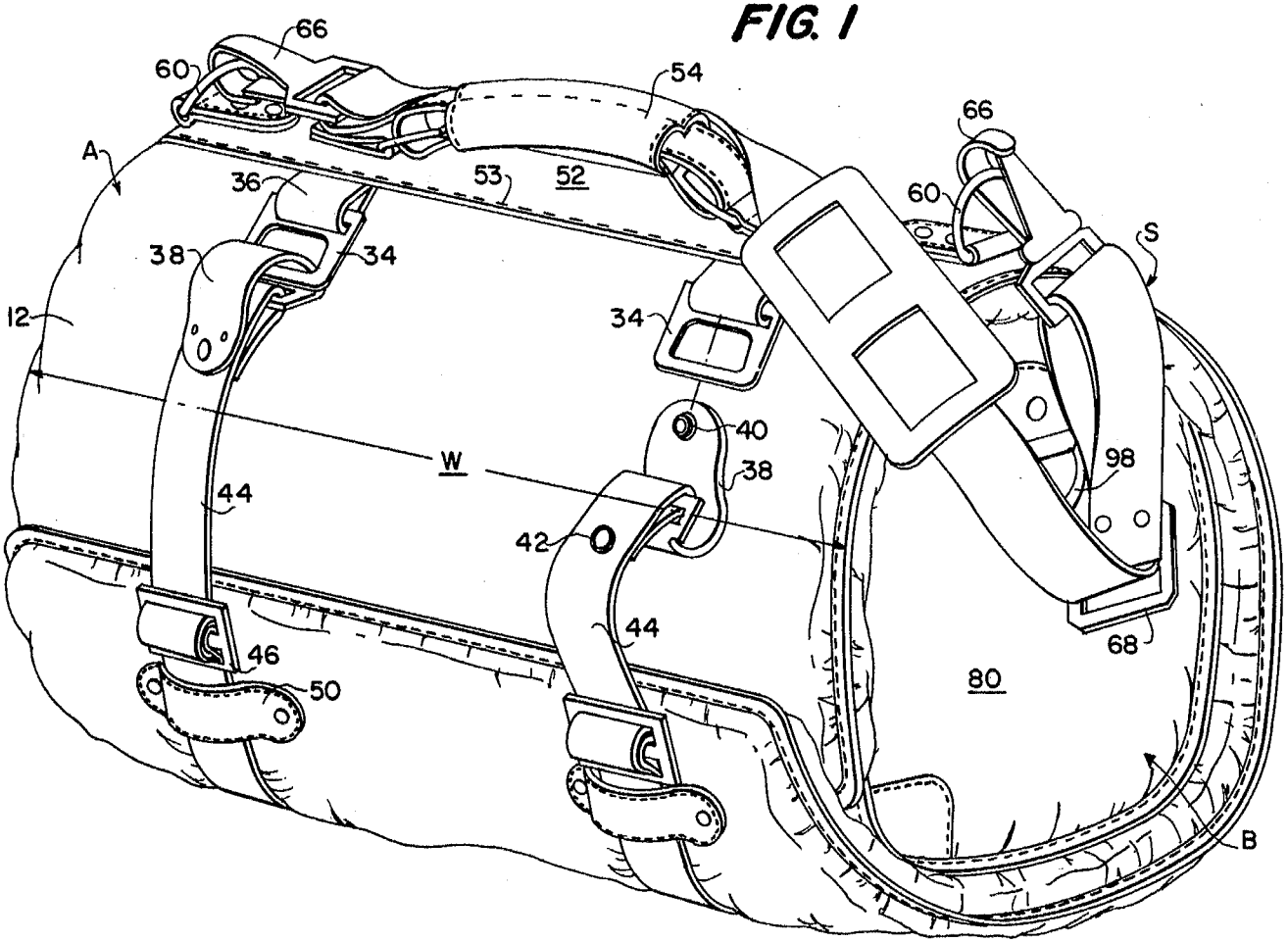
FIG. 1 is a perspective view of a garment bag and tote bag in assembled relationship ready for carrying.
Figure 2:
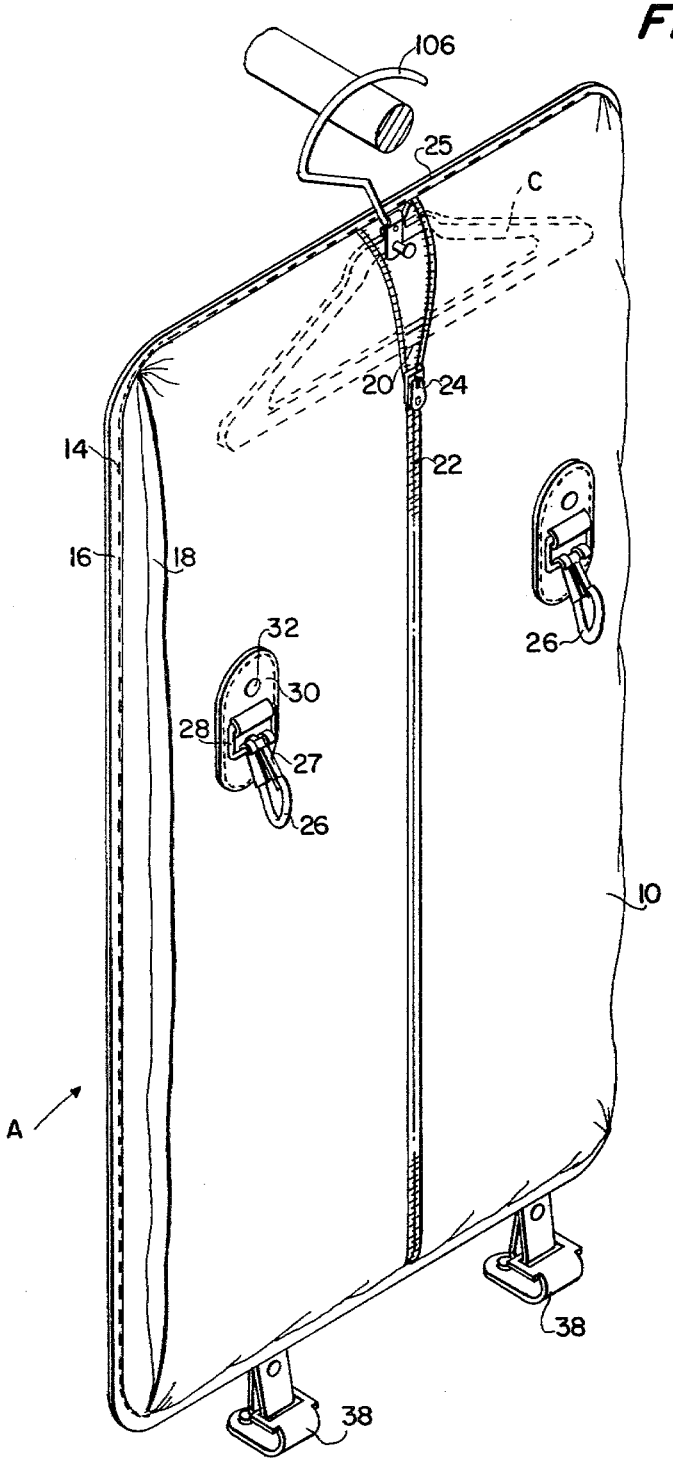
FIG. 2 is a perspective view of the garment bag in its extended condition showing one side thereof.

Referring to FIGS. 1–6, a garment bag-tote bag assembly in accordance with the invention comprises a garment bag A and a carrying case or tote bag B. The garment bag comprises first and second panels 10, 12 of flexible material connected to one another at their peripheral edges 14. The edges are sewn or heat sealed to one another, and preferably reinforced with a strip 16. To impart greater volume to the bag, one of the panels 10 may be provided with a gusset portion 18 along each of its longitudinal sides, as shown in FIG. 2. The garment bag is provided with a longitudinally extending opening 20 provided with a closure 22 preferably in the form of a slide fastener. The opening and slide fastener are positioned centrally of the panel 10, and when the slider 24 of the fastener is in its fully closed position, the slider is located at the top 25 of the garment bag, as is well known in the art. If desired, the slide fastener may be located at the side of the garment bag in the area of the gusset 18. The flexible material of which the panels 10 and 12 are made preferably is weather- or water-resistant, sewable and/or heat-sealable, for example, plastic sheet material such as vinyl sheeting, or a coated fabric such as canvas coated with a suitable waterproofing composition. Various waterproofing compositions may be used, for example, polyvinyl chloride, copolymers of vinyl chloride and vinyl acetate, copolymers and terpolymers of styrene, etc.

The tote bag B has a length 1 (FIG. 6), substantially equal to the width w (FIG. 1) of the garment bag A, and the garment bag has a length L (FIG. 3) not less than the circumference of the tote bag. The circumference of the tote bag is the measurement of its girth, which is in a direction transverse to the length of the bag as viewed in FIG. 4. Such dimensional relationships of the garment bag and tote bag will be apparent from a viewing of FIG. 1 which shows the garment bag surrounding or enveloping the tote bag with the ends of the tote bag exposed. Preferably, the length L is greater than the circumference of the tote bag so that the ends of the garment bag are overlapped when the garment bag and tote bag are in assembled relationship, as shown in FIG. 1.

Figure 4:
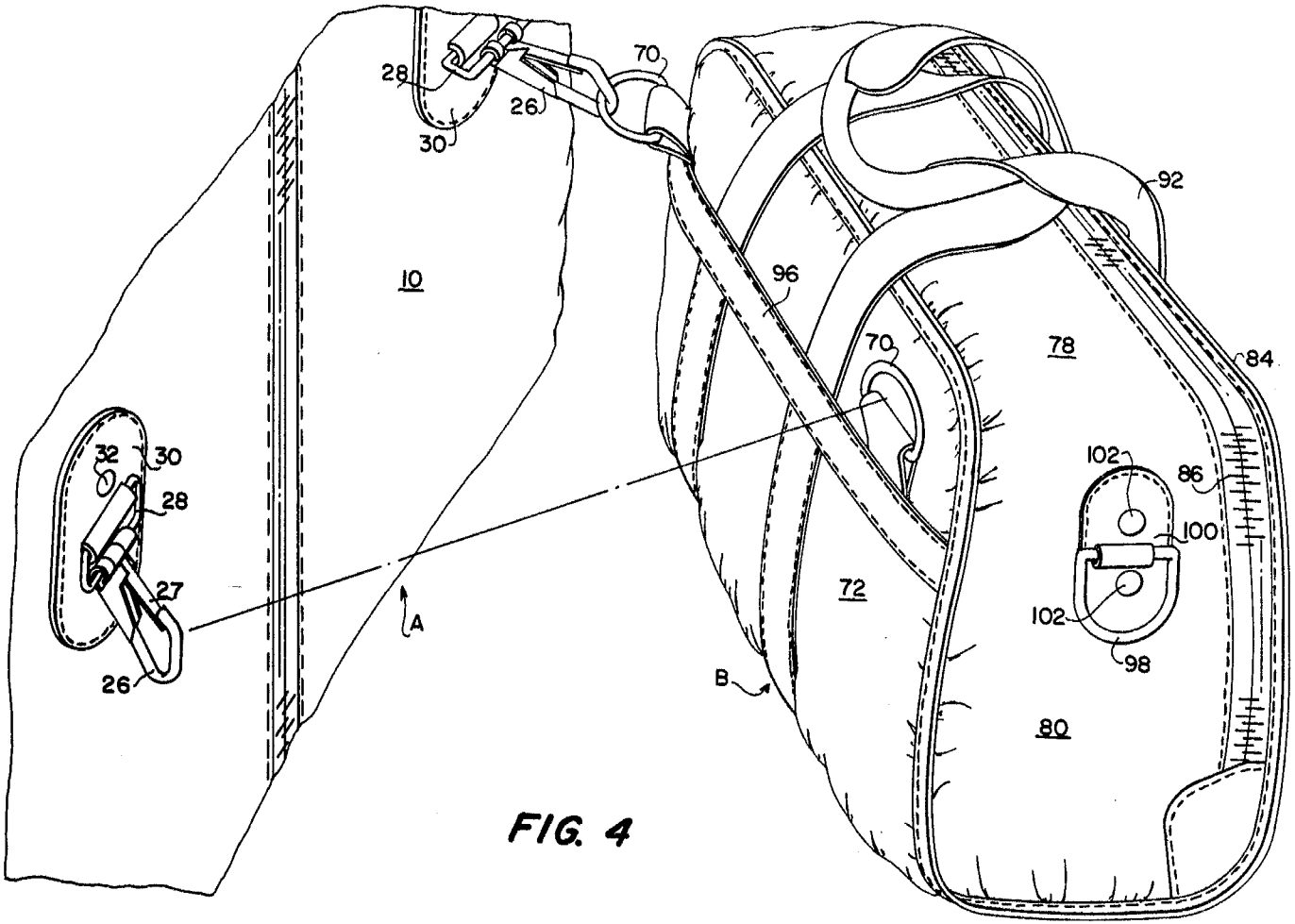
FIG. 4 is a perspective view showing the manner in which the garment bag and the tote bag are separably connected to one another, the garment bag being partially shown.

Referring to FIGS. 2 and 4, the garment bag A is provided with connector means to enable the garment bag and the tote bag to be separably connected. For this purpose, a pair of laterally spaced snap-hook fasteners 26 are secured to the panel 10 which will be the inner panel when the garment bag and tote bag are in the assembled relationship as shown in FIG. 1. As shown in FIG. 2, the snap-hook fasteners are of the so-called "dog-leash-type"; that is, a leaf spring member 27 is provided for coaction with the free end of a curved rigid member. The fastener may be fixed to a ring member 28 which in turn is pivotally connected to a base 30 which is sewn to the panel 10. Rivets 32 may be used to further secure the base 30 to the panel 10.

Figure 3:
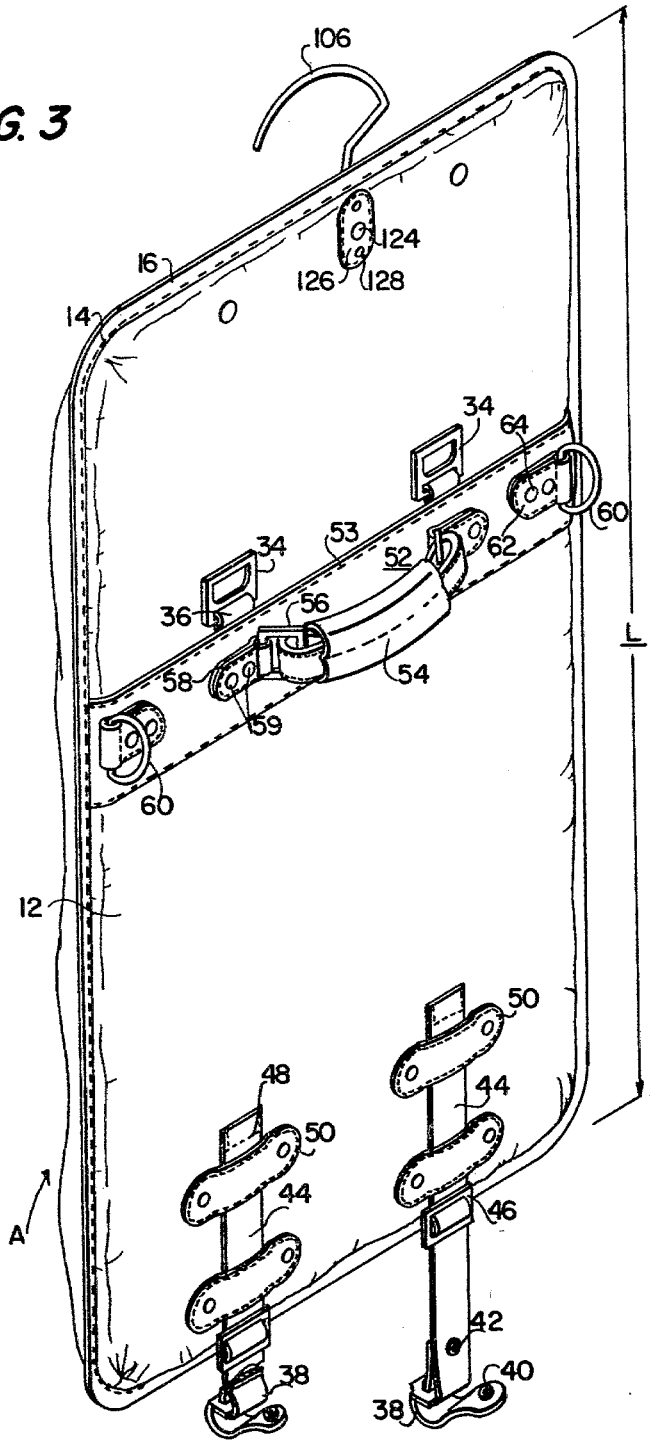
FIG. 3 is a view similar to FIG. 2 showing the opposite side of the garment bag.

On the opposite side of the garment bag A, there are provided longitudinally spaced cooperable connector means secured to the second panel 12 for separable connection to each other. When the garment bag is in assembled relationship with the tote bag as shown in FIG. 1, the panel 12 will be the outer panel. As shown in FIG. 3, the longitudinally spaced cooperable connector means may comprise a pair of laterally spaced D-rings 34 which are pivotally connected to the panel 12 at 36 approximately one-third the way down from the top 25 of the garment bag. A pair of connectors 38 are secured to the panel 12 laterally spaced apart the same distance as and for cooperation with the connectors 34. As shown, the connectors 38 are formed as hooks to pass through the openings in the respective D-rings, and each hook has a projection 40 which is snapped into a socket 42 to releasably secure the connection. This type of connector is well known in the art, and is only one example of a connector which may be used. If desired, a dog-leash-type of connector may be used here as well. Also, any suitable type of separable connector may be used as the connector means on the garment bag to enable separable connection to the tote bag. For example, the hook fastener of the type designated 38 may be used instead of the snap hook spring fastener 26.

As shown in FIGS. 1 and 3, the connectors 38 are secured to straps 44 and members 46 are provided on the straps to enable adjusting the length of each strap, and thereby adjust the position of the connectors 38. The straps are sewn to the panel 12 at 48, and reinforcing guide members 50 are sewn and riveted to the panel 12 for the passage of the straps thereunder. The manner in which the snap-hook fasteners 38 are connected and disengaged from the D-ring connectors 34 is illustrated in FIG. 1.

Further with regard to the garment bag A, and as shown in FIGS. 1 and 3, the garment bag is provided with means to enable carrying the garment bag-tote bag assembly. Two separate means are shown. A reinforcing base strip 52 is secured to the panel 12 as by sewing. The strap which extends across the width of the panel is made of a relatively heavy material such as leather or synthetic leather, and is located immediately adjacent the connectors 34. If desired, the pieces of fabric which are turned onto themselves so that the bights thereof may provide pivots 36 for the D-rings 34 may have the ends of the pieces underneath the strip 52 so that the same line of stitching 53 for the reinforcing base strip will connect the pieces 36 to the panel. A handle 54 is secured to the base strip in a manner well known in the art. The ends of the handle may be connected to the securing means 58 which are connected to the base strip 52 by rivets 59. The handle 54 is, of course, of the type which permits carrying the assembly A–B of FIG. 1 manually.

The second means enabling carrying of the garment bag-tote bag assembly is in the form of a pair of D-rings 60 which are laterally spaced, one on each side of the handle 54. The rings are each pivotally connected to the reinforcing strip 52 by a member 62 of heavy material providing a bight to receive the straight portion of the D-ring, the member being secured to the strip by rivets 64. Such rings permit the connection thereto of a strap S, as shown in FIG. 1. The strap is of a type well known in the art, and may consist of a snap-hook fastener 66 at each end, and may be provided with an adjusting member 68 permitting the strap to be shortened or lengthened to suit the needs of the particular traveller. As will subsequently appear, the same strap may be used for carrying the tote bag when the tote bag is separated from the garment bag and it is desired to use the tote bag alone.

The carrying case or tote bag B may be of any desired construction, it only being essential in the preferred form of the invention that the bag be provided with connector means secured to a wall thereof which is cooperable with the connector means 26 secured to the garment bag. It will be understood that the term "tote bag" is used for convenience only. It is intended that this term shall include any piece of luggage suitable for carrying articles other than a garment bag which has the dimensional relationship to a garment bag as herein explained and which is adapted for assembly with a garment bag as herein described. For preferred assembly purposes, and as shown in FIG. 5, the tote bag may be provided with connector means in the form of a pair of D-rings 70 which are spaced lengthwise of the bag a distance equal to the spacing of the fasteners 26 from one another. The D-rings are pivotally connected to the side wall 72 of the bag by members 74, which may be short strips of fabric each folded over upon itself with the straight portion of the ring in the bight and the ends sewn to the side wall 72.

As previously indicated the tote bag B may be of any desired construction. As shown, and for exemplary purposes only, the tote bag B has the side wall 72 and an opposite side wall 76, as shown in FIGS. 4, 5 and 6. The top wall 78 and the end walls 80 may be provided by a single piece of flexible material, and finally there is the base or bottom wall 82, which is stiffened, as by placing a card board insert between a pair of layers of material before sewing the pieces of material to one another along their adjacent edges. The bottom may be provided with spaced metal studs or feet 83. The edges may be reinforced by a binding strip 84. Access to the interior of the bag or container may be provided by an opening extending substantially along the entire sides and top of the bag, the opening being provided with a closure, such as a slide fastener 86 (FIG. 4). If desired, one side of the bag may be provided with a pocket for small articles, access to the pocket being an opening 88 extending across the length of the side 76 with the opening provided with a slide fastener closure 90 as shown in FIG. 6.

Means is provided for carrying the tote bag B and in the form of the invention illustrated two such means are shown. For hand carrying the bag a grip member 92 is secured to each side of the bag. Each grip member may be simply a strip of strong fabric each end section of which is sewn to one side of the case with the intermediate section free for grasping by the hand. The intermediate or free section may be treated with a composition which imparts stiffness to the fabric. To reinforce the connection of these handle grips to the bag longitudinally extending reinforcing srips 96 may be sewn to each side of the case and over the spaced end sections of the grip members.

If it is desired to carry the tote bag B, and still leave the hands free, each end wall of the bag is provided with connector means to enable securing the carrying strap S to the bag. For this purpose a D-ring 98 preferably is pivotally connected to a base member 100 of heavy material such as leather or synthetic leather which in turn is secured to each side wall 80. To reinforce the connection rivets 102 may be extended through the base member and the wall 80. As will be apparent from FIG. 5 the connectors 66 at the ends of the strap S may be separably connected to the rings 98 so that the tote bag may be carried by placing the strap over the shoulder. If desired, the garment bag-tote bag assembly A–B may be carried by hooking the connectors 66 through the rings 98 when the two bags are in the assembled relationship shown in FIG. 1.

Figure 7:
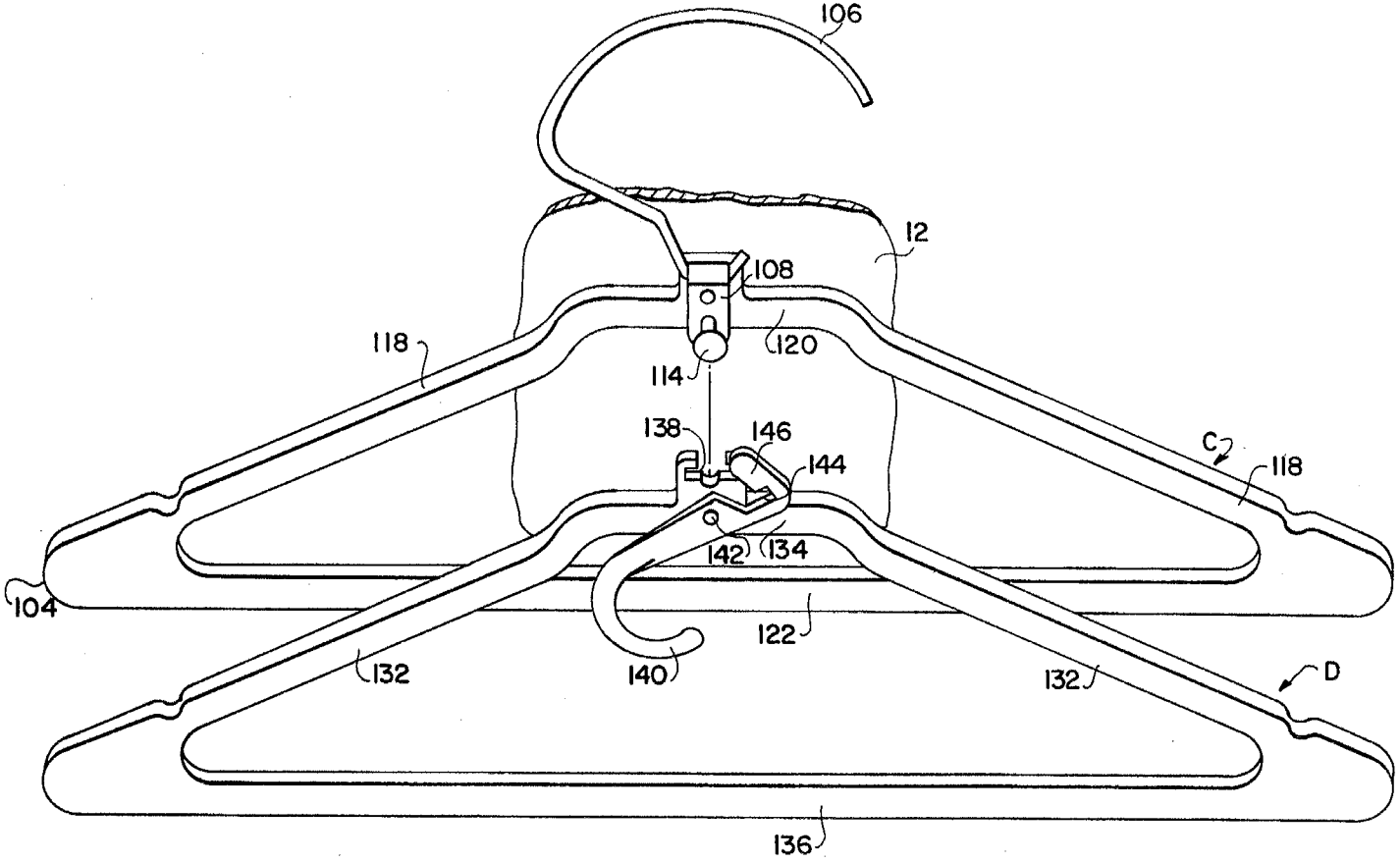
FIG. 7 is a front elevational view of a hanger which is particularly adapted for use in a garment bag of the type herein disclosed, the hanger shown having the hook thereof oriented for engagement with a pole in a closet or the like, this view also showing how a second hanger is connectable to the hanger having the hook.
Figure 8:
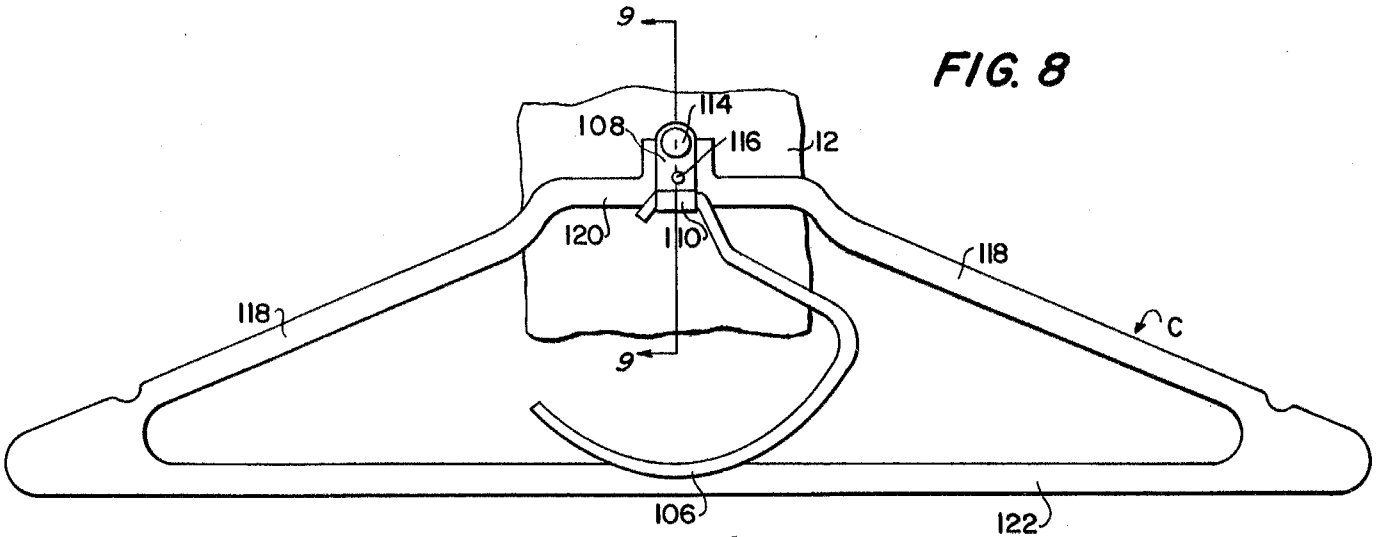
FIG. 8 is a front elevational view of the hanger provided with the hook, this view showing the hook rotated to the position which it has when the hanger is within the garment bag and the garment bag is assembled with the tote bag.
Figure 9:
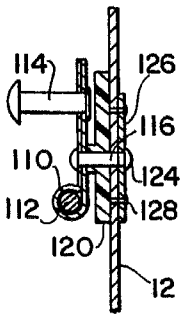
FIG. 9 is a vertical cross-sectional view taken approximately in the plane of line 9—9 in FIG. 8.

A hanger or hangers for the men's suits or women's dresses to be hung in the garment bag should be of a consruction which does not interfere with the assembly of the garment bag with the tote bag as illustrated in FIG. 1; that is to say, the hanger may not have any protruding portion which would interrupt the continuity or the curvature of the garment bag. The hanger C shown in FIGS. 7, 8 and 9 is particularly designed to fulfill this condition. This garment hanger comprises a supporting member or frame 104 of suitable rigidity, or stiffness, and a substantially rigid hook 106 connected to the frame by a swivel member 108. The swivel member is provided at one end with means 110 to receive a portion 112 of the hook member 106 to allow the hook member to be pivoted from the position shown in FIG. 7 to the position shown in FIG. 8 and vice versa. At the opposite end of the swivel member an upstanding headed stud 114 is provided to enable the connection of a second or another hanger D to the hanger C (FIG. 7). The swivel member 108 is pivotally connected to the garment supporting member 104 by a pin 116 which defines a first axis of movement for the hook. As shown, in FIG. 9, the swivel member may be a metal strip bent upon itself to furnish the bearing 110 for section 112 of the hook 116. The bearing defines a second axis of movement for the hook perpendicular to the first axis.

As shown in FIG. 7 the garment supporting frame 104 comprises a pair of arms 118 which diverge laterally downwardly from each side of a top central portion 120. A cross bar 122 extends between the lower ends of the diverging arms 118. Preferably the supporting frame is made by molding a suitable synthetic resin molding compound to furnish the desired stiffness. The upper central portion 120 has the swivel member 108 pivotally connected thereto by the pivot pin 116. When the hanger C is in the garment bag the hook 106 is in the position shown in FIG. 8. When the garment bag is in the extended position condition shown in FIGS. 2 and 3, and it is desired that the hook 106 be moved out from within the perimeter of the supporting frame as shown in FIG. 8 to the position of FIGS. 2, 3 and 7, the hook may be rotated about the pin 116 or it may be pivoted about the bearing or pivot portion 110 of the swivel member 108.

The hanger C may be used in the garment bag A and reliance placed upon the extended arms 118 with respect to the opening 20 in the garment bag to prevent the hanger from being pulled out of the bag. A plurality of hangers may be used and it is not necessary that any one of them be secured to the garment bag. It is preferred, however, to secure the hanger to the garment bag. For this purpose the pivot pin 116 can be made of a length to extend through the panel 12, the end of the pin being headed over at 124, as shown in FIGS. 3 and 9. The connection may be reinforced by positioning a reinforcing piece 126 at this area which is riveted at 128 to the panel 12.

In order to accommodate a second hanger D means is provided for cooperable or separable connection of the second hanger to the stud 114. Referring to FIG. 7, the hanger D also comprises a pair of arms 132 which diverge laterally downward from each side of a top central portion 134. A cross bar 136 extends between the lower ends of the diverging arms 132. Preferably, this hanger also is made by molding a suitable plastic composition to impart a suitable rigid supporting character to the member. The upper central portion 134 is provided with a slot 138 which is dimensioned to slip over the headed pin 114 behind the head thereof. Then, a hook member 140 which is pivotally connected to the central portion 134 at 142 is rotated so that the pin 114 is received in a slot 144 in the hook member, and as a result a segment 146 of the hook member is positioned over the pin to suspend hanger D on the hanger C.

While the hanger illustrated in FIGS. 7–9 and as herebefore described is preferred, another hanger or plurality of hangers having the construction as described in Feinberg U.S. Pat. No. 3,870,206; granted Mar. 11, 1975 also is particularly adapted for use with the assembly of the invention.

While the advantages of the invention may be realized by using a garment bag having a length at least approximately equal to the circumference of the carrying case or tote bag, it is preferred that the garment bag have a length which exceeds the circumference of the tote bag so that the garment bag in its assembled relationship with the tote bag has the ends thereof overlapped, as shown in FIG. 1. For example, a garment bag and a tote bag having the dimensions as hereinafter set forth have furnished all of the advantages and improved results of the invention. Garment bag: 41 inches long and 21 inches wide. Tote bag: 20 inches long, 7 inches wide at the base and 5 inches wide at the top and 11 inches high, and having a circumference of 33 inches.

A garment bag-tote bag assembly having the aforementioned dimensions and dimensional relationship with one man's suit in the garment bag may be placed under the seat of an airplane. The space under the seat of an airplane is 13 inches wide, 23 inches deep or long and 9 inches high. The garment bag may hold several women's dresses because of their lighter fabric. When more than one suit is in the garment bag, it may be desired to separate the garment bag from the tote bag, and place the tote bag under the seat and hang the garment bag on a rack. There is still the substantial advantage of being able to carry the assembly of garment bag and tote bag, as shown in FIG. 1, to the airplane, and when disembarking, the reassembly of the two bags may be very quickly and readily accomplished.

While a preferred embodiment of the invention has been illustrated and described, it is believed that various modifications and changes may be made without departing from the spirit and scope of the invention as sought to be defined in the claims.

I claim:

1. A garment hanger comprising a pair of arms diverging downwardly from a top central portion, a hook, and means connecting said hook to said top central portion for selective movement about a pair of mutually perpendicular axes, said hook having alternative positions with respect to each axis wherein the hook is situated respectively above said top central portion and below said top central portion between said arms.

2. A garment hanger according to claim 1, wherein the swivel member is provided with means for supporting a second hanger.

3. A garment hanger according to claim 3, wherein the means for supporting the second hanger is a headed pin located on one side of the first pivotal connection, the second pivotal connection being located on the other side of said first pivotal connection.

4. A garment hanger according to claim 1, wherein said connecting means includes a swivel member, a first pivotal connection between said swivel member and said top central portion, said first pivotal connection defining one of said axes and a second pivotal connection between said hook and said swivel member, said second pivotal connection being provided by said swivel member and defining the other of said axes.

* * * * *